United States Patent [19]

De Raco et al.

[11] Patent Number: 4,551,593

[45] Date of Patent: Nov. 5, 1985

[54] MECHANISM FOR THE SUDDEN TRIPPING OF AN ELECTRICAL CONTACT UNDER THE EFFECT OF A SLOW VARIATION IN PRESSURE

[75] Inventors: Maurice De Raco, Grasse; Pierre Rey, Menton, both of France

[73] Assignee: Eaton S.A.M., Monaco, France

[21] Appl. No.: 566,072

[22] Filed: Dec. 27, 1983

[30] Foreign Application Priority Data

Nov. 21, 1983 [MC] Monaco ..... 1665

[51] Int. Cl.[4] ..... H01H 35/24

[52] U.S. Cl. ..... 200/81 R; 200/83 R

[58] Field of Search ..... 200/16 C, 61.45 R, 61.53, 200/81 R, 82 R, 82 A, 82 C, 83 R, 83 J, 83 S, 83 SA, 61.08

[56] References Cited

U.S. PATENT DOCUMENTS

| | | | |
|---|---|---|---|
| 2,837,611 | 6/1958 | Detwiler et al. | 200/83 J |
| 3,628,384 | 12/1971 | Jones | 200/61.45 R X |
| 3,735,059 | 5/1973 | Glaser | 200/16 C |

*Primary Examiner*—J. R. Scott

*Attorney, Agent, or Firm*—Mason, Fenwick & Lawrence

[57] ABSTRACT

A mechanism for the instantaneous tripping of an electrical contact in response to a progressive variation in applied fluid pressure. Contact is made by a conductive element movable along its longitudinal axis between an open position and a closed position. The upper portion of the interior wall of the contact element comprises opposed first and second sloping sections of substantially triangular cross-section having a side in common at their connection. A throttle is defined by the connection between the sloping sections. A cage member partially positioned within the conductive element is movable therein in response to the applied fluid pressure. The cage member includes a head portion having a channel therethrough perpendicular to the longitudinal axis of the conductive element. At least one ball is housed in the channel and is movable along the longitudinal axis of the channel and up and down the sloping sections in response to the movement of the cage member within the conductive element. The ball is subjected to an elastic force directed toward the sloping sections, the force breaking down into oppositely directed vertical components parallel to the longitudinal axis of the conductive element. A spring engaging the cage exerts an elastic force on the cage in opposition to the pressure variations to be controlled. The passage of the ball through the throttle causes the instantaneous displacement of the conductive element from one to the other of the open and closed positions.

12 Claims, 4 Drawing Figures

MECHANISM FOR THE SUDDEN TRIPPING OF AN ELECTRICAL CONTACT UNDER THE EFFECT OF A SLOW VARIATION IN PRESSURE

BACKGROUND OF THE INVENTION

The present invention relates to a mechanism for the sudden or instantaneous tripping of an electrical contact under the effect of a slight and progressive variation in the pressure of any fluid, particularly oil pressure for example in a motor.

The mechanisms known at the present time for obtaining a similar result make use of curved elastic blades which, although performing their function effectively, are relatively bulky. The invention makes it possible to achieve an even more accurate result, while at the same time ensuring a greatly reduced bulk of less than 10 mm.

SUMMARY OF THE INVENTION

For this purpose, the invention is directed at a mechanism for the sudden (instantaneous) tripping of an electrical contact under the effect of a slow (progressive) variation in pressure, wherein the contact is made by means of a conductive element movable in a first direction between an "open" position and a "closed" position and having two slopes directed transversely to the first direction, thus defining a throttle along the connection between them. An axial or ball cage component subjected to the pressure is movable parallel to the longitudinal axis of this conductive element and includes a channel 27 for at least one ball movable in a second direction perpendicular to the first direction. The ball is subjected to a means which exerts on it an elastic force directed towards the slopes. The elastic force transmitted by the ball to the slopes breaks down into a vertical component exerted parallel to the first direction on the first of the slopes one way and on the second of the slopes the opposite way, so that the passage of the ball from one side of the throttle to the other causes the instantaneous displacement of the contact from one of its positions to the other.

More precisely, since the device as a whole is a body of revolution, the conductive element is a cylindrical cage which has on the inside two sloping sections of substantially triangular cross-section having a side in common at their connection, thus defining a circular throttle, while the ball cage component sensitive to pressure is coaxial with this conductive element and incorporates a radial channel for at least one ball pushed by a spring towards the slopes. The axial displacment of this ball cage component under the effect of the pressure variations causes the ball to pass from one slope to the other, the axial component of the force transmitted by the ball to the slopes undergoing a sudden change in direction as the result of passage through the throttle and determining the instantaneous axial displacement in one direction or the other of the conductive element which thus joins together two electrical contacts or, on the contrary, cuts them off from one another.

In addition to its small bulk, the device according to the invention is of very high precision. Thus, the value of the pressure variation, at which the ball passes from one slope to the other through the throttle connecting the two slopes, is determined by an adjusting screw which modifies the force with which the ball cage component opposes the pressure variations to be controlled.

Furthermore, this device has a high degree of reliability. Thus, the displacements of the central component are limited so as to make it sensitive only to slight pressure variations and not to accidental excess pressures.

In practice, as will be described in more detail below, the ball cage component incorporates a channel which receives two balls pushed radially towards the slopes by a single spring which balances the transverse forces and allows the component and the conductive element to float in relation to the housing of the device.

BRIEF DESCRIPTION OF THE DRAWINGS

The latter embodiment of the invention will be described in more detail with reference to the attached drawing in which.

Of course, the same reference numerals denote the same elements which perform the same function in the two alternative forms.

DESCRIPTION OF THE PREFERRED EMBODIMENTS

Figure 1A:
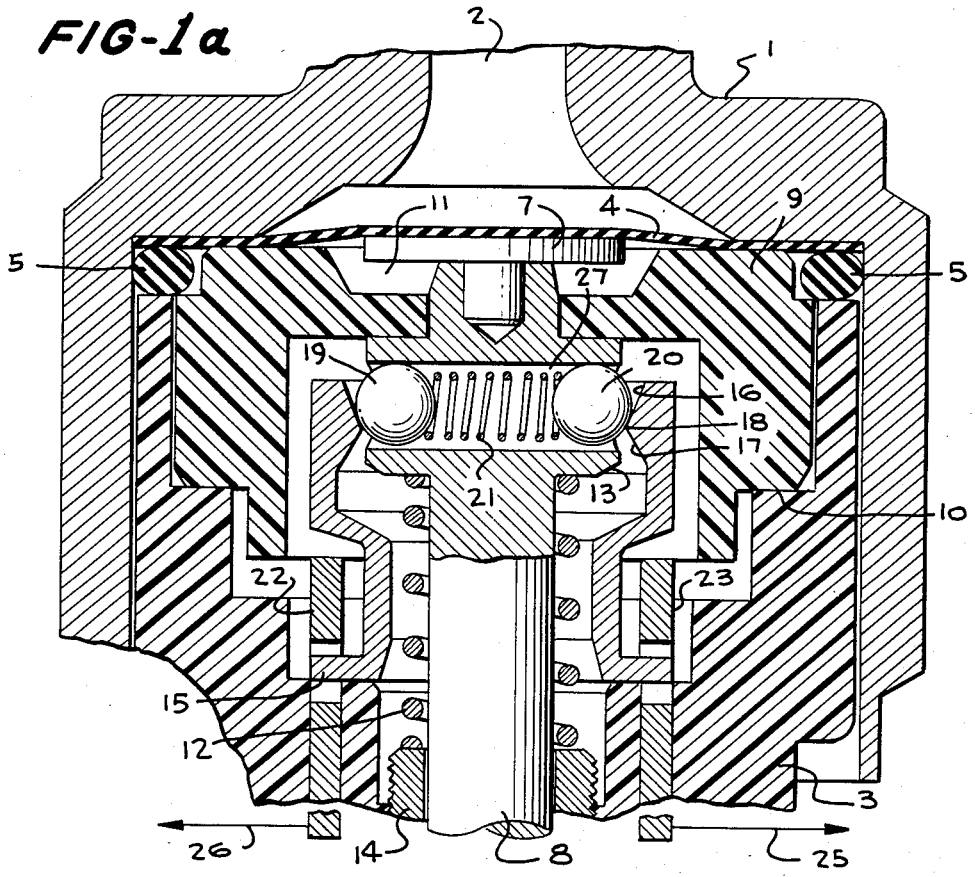
FIG. 1*a* is an axial section through a mechanism according to the invention, of the type which is normally open in the position of rest, whereas, on the contrary.

Thus, the Figures show, mounted in a housing 1 made of metal, such as brass, galvanized steel or the alloy known by the trademark "Zarmac" is connected to a source of fluid under pressure by a pipe designated diagrammatically by 2, the device according to the invention which, in the two alternative forms illustrated in the Figures, has a general cylindrical shape.

This device consists of a body 3 made of plastic, such as a polyamide, arranged in the inflow part facing the admission of fluid under pressure through pipe 2 by means of a diaphragm 4 or 6 which can be associated with a gasket 5 or which itself incorporates a rim constituting this gasket. It is this diaphragm 4 or 6 which is subjected to the pressure of the fluid arriving in the pipe 2. It can be made of a thin film of polyamide (4) or a fluorinated elastomer (6).

This diaphragm can be deformed, at the same time moving during its displacement a brass disk 7 firmly fixed, for example as a result of simple centering, to a ball cage 8 also made of brass, which is mounted coaxially with the housing and passes through an orifice in a plastic spacer 9 bearing on a shoulder 10 of the plastic body 3.

The assembly consisting of the disk 7 and the ball cage 8 can be displaced axially under the effect of the deformations of the diaphragm 4 over a distance equal to the depth of a dish 11 made in the upper face of the spacer 9. This displacement takes place counter to a spring 12 located between the head 13 on the ball cage 8 and an adjusting screw 14 accessible at the other end of the device.

Mounted inside the spacer 9 and coaxially in relation to the assembly as a whole there is a cylindrical conductive element 15 or 15' , for example made of silver-plated brass, the special feature of which is that it has towards its upper part two slopes 16 and 17 respectively substantially triangular cross-section having a side in common at their connection, thus forming a throttle designated by 18.

This part 16, 17, 18 of the conductive element 15 or 15' represents one of the essential elements of the device according to the invention.

At the level of this zone, the head 13 of the ball cage 18 has a cylindrical channel, in which are mounted two identical balls 19 and 20 pushed outwards by means of a spring 21.

The lower end of the conductive element 15 or 15' which joins together two brass tongues 22 and 23 connected to the conductors 25 and 26 constituting the two terminals of the electrical contact to be opened or closed. When the device is in its position of rest, the lower part of the conductive element 15 is either separated from the tongues 22 and 23 in the alternative form shown in FIGS. 1*a* and 1*b* or, on the contrary, the lower part of cage 15' is in contact with these tongues in the alternative form shown in FIGS. 2*a* and 2*b*.

The device then functions as follows:

In the position of rest, the spring 12 pushes the ball cage 8 towards its upper part, the disk 7 being outside the dish 11.

Under these circumstances, the balls 19 and 20 bear on the slope 16 under the effect of the spring 21.

In the event of a progressive increase in pressure, the diaphragm 4 or 6 is gradually deformed downwards, thus pressing down the disk 7 which pushes the ball cage 8 counter both to the spring 12 and to the balls 19 and 20 which, at the start of this downward displacement, move towards one another counter to the spring 21.

When this progressive increase in pressure is such that the balls 19 and 20 pass the throttle 18, the spring 21 pushes the balls 19 and 20 abruptly towards the slope 17, and the vertical component of the force exerted by the spring 21 on each of the balls 19 and 20 is then exerted downwards, thus instantaneously pushing the conductive element 15 or 15' upwards.

Figure 1B:
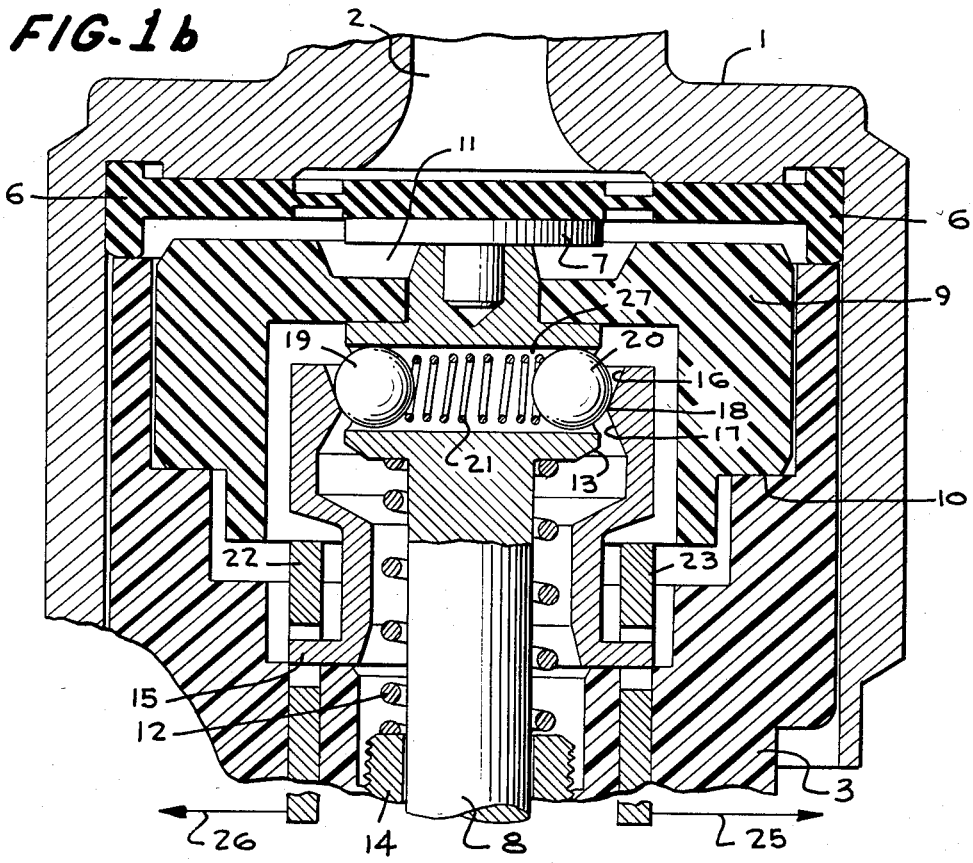
FIG. 1*b* is an axial section through an alternate embodiment of the mechanism shown in FIG. 1*a*.
Figure 2A:
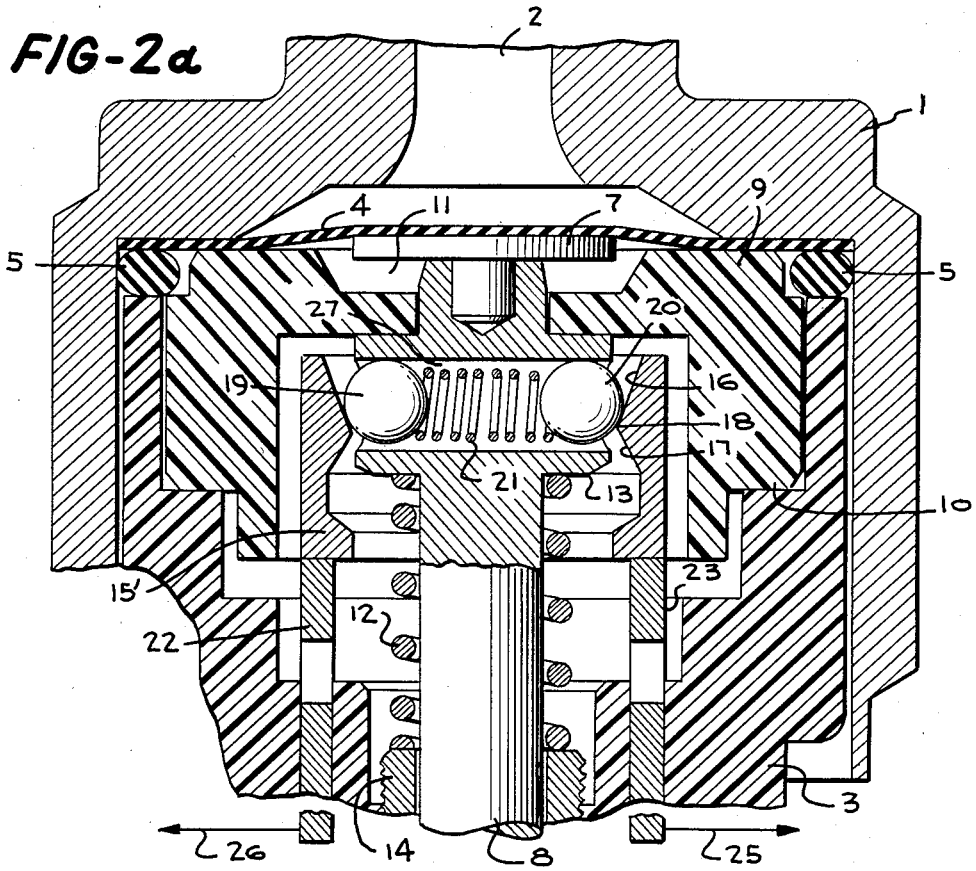
FIG. 2*a* is a similar view of an alternative form of this mechanism, in which the contact is normally closed in the position of rest.
Figure 2B:
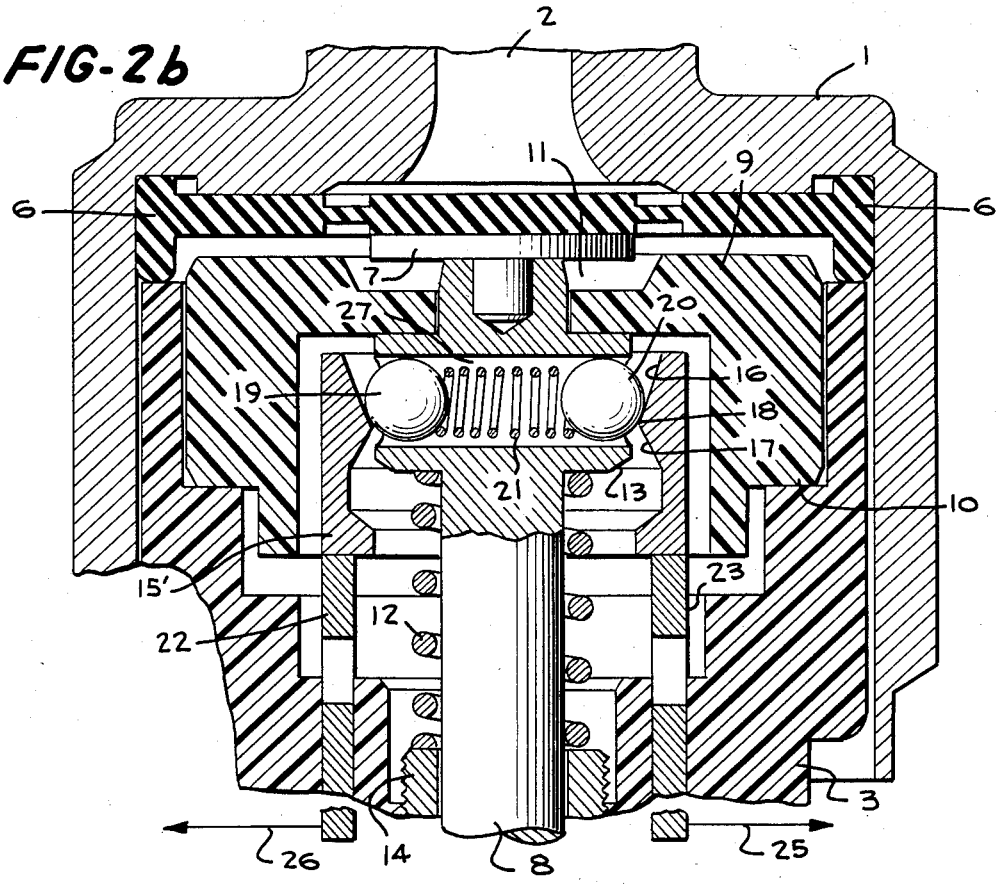
FIG. 2*b* is an axial section through an alternate embodiment of the mechanism shown in FIG. 2*a*.

Under these circumstances, the lower part of the conductive element 15 or 15' will function as a conductive element between the tongues 22 and 23 in the two different directions, depending on the alternative form selected:

As regards FIGS. 1*a* and 1*b*, the parts constituting the bottom of the cage 15 will abruptly close the contact between the tongues 22 and 23, whereas, on the contrary, in the alternative form shown in FIGS. 2*a* and 2*b*, the bases of the conductive element 15' will abruptly cut off contact between the tongues 22 and 23.

In both cases, tripping will be all the more instantaneous because the upward displacement of the conductive element 15 or 15', at the moment when the balls 19 and 20 pass from the slope 16 to the slope 17 over the throttle 18, represents an extremely narrow space of the order of only ½ mm.

As soon as the pressure in the pipe 2 drops again below that which causes this tripping, the spring 12 pushes back the ball cage 8 and consequently the balls 19 and 20 on the other side again, that is to say on the side located above the throttle 18, and the conductive element 15 or 15' again performs its sudden tripping function by separating or joining together the tongues 22 and 23 according to the alternative forms in FIGS. 1*a* and 1*b* or 2*a* and 2*b* respectively.

It is appropriate to note that, since the depth of the dish 11 is approximately equal to the thickness of the disk 7, in the event of excess pressure there is no risk that the balls 19 and 20 will bear on the lower part of the conductive element 15 or 15', thus causing inopportune cutting-off or closing of the contact between the tongues 22 and 23.

It is also appropriate to note that the coaxial arrangement of all the elements allows a high degree of operating reliability. Thus, the only guidance provided for the ball cage 8 is that resulting from the presence of the adjusting screw 14 and the orifice made in the upper face of the spacer 9, so that the centering of this ball cage 8 can be considered as arising solely from the centering of its tail, and it floats in the device in such a way that it performs a self-centering function which ensures operating reliability, this being important when it is remembered that this mode of operation arises from the existence of horizontal and vertical components of forces exerted on zones which are oblique relative to the axis of the system.

Moreover, the conductive element 15 or 15' does not have any special guide means other than the action of the balls 19 and 20 which is symmetrical; the result of this is that this conductive element 15 or 15' is in fact constantly cantilevered, so that at the moment when it comes in contact with the two tongues 22 and 23, even if these two tongues are not strictly at the same height, contact will nevertheless be made between them, since the conductive element 15 or 15' can absorb the slight inclination which compensates this height difference.

As mentioned at the beginning, this system can be produced by means of elements of very small dimensions: thus, as regards a cylindrical system as illustrated, the total diameter of the device can be reduced to less than 10 mm, this being much less bulky than existing systems with curved blades.

Of course, the various elements of this device can assume slightly different forms, seeing that they perform the same functions, although it goes without saying that the essential characteristics of this mechanism are those arising from the following claims.

We claim:

1. A mechanism for the instantaneous tripping of an electrical contact in response to a progressive variation in applied fluid pressure, comprising:

a housing, the interior of said housing being fluid connected to a source of pressurized fluid, a conductive element located in said housing, said conductive element having a longitudinal axis and movable along said axis between an open position and a closed position and having an interior wall and an exterior wall, said interior wall at the upper portion thereof comprising opposed first and second connecting sloping sections of substantially triangular cross-section having a side in common at their connection, and a throttle defined by the connection between said first and second sloping sections, cage means at least partially positioned within said conductive element and movable therein in response to the applied fluid pressure in a direction substantially parallel to said longitudinal axis of said conductive element, said cage means including a head portion having channel means therethrough, said channel means having a longitudinal axis substantially perpendicular to said longitudinal axis of said conductive element, and at least one ball housed in said channel means and movable along said longitudinal axis of said channel means and up and down said sloping sections in response to the movement of said cage means within said conductive element, first means for exerting on said at least one ball a transverse elastic force substantially parallel to said longitudinal axis of said channel means and directed towards said sloping sections, said force breaking down into a first vertical component acting on said first sloping section in a first direction substantially parallel to said longitudinal axis of said conductive element and a second vertical component acting on said second sloping section in a second direction opposite said first direction, and second means engaging said cage means for exerting an said cage means an elastic force in opposition to the pressure variations to be controlled, the passage of said at least one ball through said throttle causing the instantaneous displacement of said conductive element from one to the other of said open and closed positions.

2. The mechanism of claim 1, said mechanism as a whole comprising a body of revolution, said conductive element being substantially cylindrical and said throttle being substantially circular, said cage means being substantially cylindrical and coaxial with said conductive element, said longitudinal axis of said channel means being located along a diameter of said cage means, said first exerting means comprising a spring disposed in said channel means, and the axial displacement of said cage means in response to the variations in the applied fluid pressure causing said at least one ball to pass from one to the other of said sloping sections, the vertical component of the force transmitted by said at least one ball to said sloping sections undergoing a substantially instantaneous change in direction upon passage through said throttle and causing the substantially instantaneous axial displacement of said conductive element to said open or closed position.

3. A mechanism as claimed in claim 1, further comprising adjusting means engaging said second exerting means for modifying the force with which said cage means opposes the pressure variations to be controlled and determining the value of the pressure variation at which said at least one ball passes through said throttle.

4. A mechanism as claimed in claim 3, further comprising means for limiting the displacement of said cage means for making said cage means sensitive only to slight pressure variations and not to accidental excess pressures.

5. A mechanism as claimed in claim 4, wherein two balls are housed at opposite ends of said channel means and said exerting means comprises a single spring interposed between said balls which balances the transverse forces and allows said cage means and said conductive element to float in relation to said housing.

6. A mechanism as claimed in claim 2, further comprising adjusting means engaging said second exerting means for modifying the force with which said cage means opposes the pressure variations to be controlled and determining the value of the pressure variation at which said at least one ball passes through said throttle.

7. A mechanism as claimed in claim 6, further comprising means for limiting the displacement of said cage means for making said cage means sensitive only to slight pressure variations and not to accidental excess pressures.

8. A mechanism as claimed in claim 7, wherein two balls are housed at opposite ends of said channel means and said exerting means comprises a single spring interposed between said balls which balances the transverse forces and allows said cage means and said conductive element to float in relation to said housing.

9. A mechanism as claimed in claim 1, further comprising means for limiting the displacement of said cage means for making said cage means sensitive only to slight pressure variations and not to accidental excess pressures.

10. A mechanism as claimed in claim 1, wherein two balls are housed at opposite ends of said channel means and said exerting means comprises a single spring interposed between said balls which balances the transverse forces and allows said cage means and said conductive element to float in relation to said housing.

11. A mechanism as claimed in claim 2, further comprising means for limiting the displacement of said cage means for making said cage means sensitive only to slight pressure variations and not to accidental excess pressures.

12. A mechanism as claimed in claim 2, wherein two balls are housed at opposite ends of said channel means and said exerting means comprises a single spring interposed between said balls which balances the transverse forces and allows said cage means and said conductive element to float in relation to said housing.

* * * * *